US005083424A

United States Patent [19]

Becker

[11] Patent Number: 5,083,424

[45] Date of Patent: Jan. 28, 1992

[54] HEAT SHIELD CONFIGURATION WITH LOW COOLANT CONSUMPTION

[75] Inventor: Bernard Becker, Mülheim/Ruhr, Fed. Rep. of Germany

[73] Assignee: Siemens Aktiengesellschaft, Munich, Fed. Rep. of Germany

[21] Appl. No.: 625,201

[22] Filed: Dec. 10, 1990

Related U.S. Application Data

[63] Continuation of PCT/DE89/00125 Mar. 10, 1989.

[30] Foreign Application Priority Data

Jun. 13, 1988 [DE] Fed. Rep. of Germany ..... 3820104

[51] Int. Cl.[5] ..... F02C 7/20; E04B 1/38; F23M 5/00; F16D 3/80

[52] U.S. Cl. ..... 60/39.31; 60/39.32; 60/754; 110/336; 110/339; 52/508; 52/511; 403/31

[58] Field of Search ..... 60/39.83, 751, 752, 60/753, 754, 39.31, 39.32; 110/336, 339; 52/508, 511, 510; 403/27, 28, 29, 30

[56] References Cited

U.S. PATENT DOCUMENTS

| | | | |
|---|---|---|---|
| 2,660,050 | 11/1953 | Hosbein | 110/336 |
| 2,827,784 | 3/1958 | Lambert | 110/336 |
| 4,569,659 | 2/1986 | Olsen | 110/336 |
| 4,840,131 | 6/1989 | Meumann | 110/336 |
| 4,944,151 | 7/1990 | Hovnanian | 60/752 |

*Primary Examiner*—Louis J. Casaregola
*Attorney, Agent, or Firm*—Herbert L. Lerner; Laurence A. Greenberg

[57] ABSTRACT

A heat shield configuration for structures carrying hot fluid, especially metal components of gas turbine systems and combustion chambers, includes adjacent mushroom-shaped ceramic material heat shield elements being mutually spaced apart defining expansion gaps therebetween, each of the heat shield elements having a surface-covering polygonal cap portion being flat or curved with straight or curved outer edges and a shank portion with an end facing away from the cap portion, the ends of the shank portions having beads formed thereon. A support structure on which the heat shield elements are anchored at a distance defines a space between the support structure and the heat shield elements to be subjected to fluid through channels formed in the support structure. Clamps secure the beads to the support structure and additional devices are provided for supporting the heat shield elements against the support structure. The clamps are formed of heat-resistance material, such as metal or heat-resistant alloys, with substantially greater elasticity then the ceramic material of the heat shield elements, the clamps having shapes forming springs fixing the heat shield elements on the support structure, and the clamps substantially determine a force with which the heat shield elements are retained on the support structure.

29 Claims, 2 Drawing Sheets

HEAT SHIELD CONFIGURATION WITH LOW COOLANT CONSUMPTION

CROSS-REFERENCE TO RELATED APPLICATION

This application is a continuation of International Application PCT/DE89/00125, filed Mar. 10, 1989.

The invention relates to a heat shield configuration for a support structure of arbitrary shape that carries a hot fluid, in particular metal components of gas turbine systems and combustion chambers, including heat shield elements being anchored alongside one another on a support structure in a surface-covering manner leaving expansion gaps therebetween, each heat shield element having a cap portion and a shank portion in the shape of a mushroom, the cap portion being a flat or curved polygon with straight or curved outer edges, and the space between the support structure and the heat shield configuration being subjectable to fluid through channels in the support structure.

A metal heat shield which is well suited for lining structures that are complicated in shape is described in Published European Application No. 0 224 817 A1. The amount of coolant fluid needed may be a disadvantage in such a configuration. In gas turbine systems, for instance, such a need may have to be met at the expense of the air available for combustion.

A ceramic heat shield that does not have to be cooled as much is described in German Published, Non-Prosecuted Application DE 36 25 056 A1. However, since that configuration includes identical rectangularly shaped blocks, it is not well suited for structures of arbitrarily complicated shape. Moreover, metal fasteners of the blocks are directly exposed to the hot fluid, possibly limiting its main advantage of low coolant consumption.

It is accordingly an object of the invention to provide a heat shield configuration with low coolant consumption, which overcomes the hereinafore-mentioned disadvantages of the heretofore-known devices of this general type, which is suitable for lining structures of complicated shape and which does not have any metal elements that are exposed to the hot fluid.

With the foregoing and other objects in view there is provided, in accordance with the invention, a heat shield configuration for structures carrying hot fluid, in particular metal components of gas turbine systems and combustion chambers, comprising adjacent mushroom-shaped ceramic material heat shield elements being mutually spaced apart defining expansion gaps therebetween, each of the heat shield elements having a surface-covering flat or curved polygonal cap portion with straight or curved outer edges or outlines and a shank portion with an end facing away from the cap portion, the ends of the shank portions having annular beads formed thereon, a support structure on which the heat shield elements are anchored at a distance defining a space between the support structure and the heat shield elements to be subjected to fluid through channels formed in the support structure, clamps securing the beads to the support structure, and additional means for supporting the heat shield elements against the support structure, the clamps being formed of metal or heat-resistant or heat-proof alloys with substantially greater elasticity than the ceramic material of the heat shield elements, the clamps having shapes forming springs fixing the heat shield elements on the support structure, and the clamps substantially determining a force with which the heat shield elements are retained on the support structure.

By constructing a heat shield element in the form of a mushroom, the cap portion that is exposed directly to the hot fluid can expand and deform freely away from the shank portion, without causing pronounced thermal strain. The metal clamp that encompasses the shank portion of the heat shield element and serves to anchor it to the support structure is shielded from the hot fluid by the cap portion, so that its thermal load is substantially less than that of the ceramic. A fluid that is pumped through channels in the support structure into the space between it and the heat shield therefore serves primarily not as a coolant but instead as a barrier, which is intended to prevent hot fluid from entering the space between the support structure and the heat shield through the expansion gaps between the ceramic elements, and damaging the support structure or clamps.

An essential component of the clamp is a resilient element between the portion encompassing the heat shield and the portion firmly connected to the support structure. The force with which the heat shield element is retained, by its cap portion and/or shank portion, on corresponding props that define the spacing from the support structure, is intended to be substantially determined by the spring force of the clamp and should not be excessively great, in order to reliably avoid tensile and bending strains of the ceramic that would cause breakage.

In order to positionally fix the heat shield elements and to determine the height of the space between the support structure and the heat shield configuration, the heat shield elements are additionally supported. This support can be effective on both the cap portions and the shank portions.

Therefore, in accordance with another feature of the invention, suitable props are joined firmly to either the heat shield elements or the support structure.

In accordance with a further feature of the invention, the support of the heat shield elements is effected with the clamps, and bulges of the clamps either engage recesses of the shank portions when the clamps are seated on the cap portion, or form bearing surfaces for the cap portions. The result is especially simple shapes for both the support structure and the heat shield elements, since bulges serving as props no longer need to be provided.

In accordance with an added feature of the invention, each heat shield element has a hole extending continuously through the cap and shank portion in the longitudinal direction of the shank portion. This hole may, for instance, allow access to a fastener by which the clamp is secured to the support structure.

In accordance with an additional feature of the invention, the clamp retaining the heat shield element is affixed to the support structure with a screw, and the head of the screw is located in an imaginary extension of the hole that passes through the cap and shank portions and through which access to the screw can be gained, with a screw driver, for instance. This provision makes it simple to mount the heat shield configuration from inside the structure to be lined.

In accordance with yet another feature of the invention, the shank portion of each heat shield element has a trapezoidal cross section in at least one plane, possibly with rounded angles, and the longer side of the trapezoid rests on the end of the shank portion facing away from the cap portion. This kind of shank portion is particularly well suited to the type of fastening according to the invention, with a clamp that encompasses the shank portion.

In accordance with yet a further feature of the invention, the shank portions of the heat shield elements have at least approximately the shape of bodies generated by rotation. In this way, the heat shield elements can be turned in their fastenings, which considerably simplifies aligning the elements when they are being mounted.

In accordance with yet an added feature of the invention, the clamps are secured to the support structure in such a way that they close by themselves during mounting. This is attained if the clamps are secured either in corresponding, preferably approximately conical countersunk recesses of the support structure, or in corresponding sockets that are attached to the support structure.

In accordance with yet an additional feature of the invention, the shape of the clamp is that of a bulging barrel, and/or a convex double cone with double truncation, in each case with slit walls. These are the shapes that best assure resilient seating of the heat shield element. The region of largest diameter of the clamp then serves as the resilient element.

In accordance with again another feature of the invention, the clamps are constructed for fastening the heat shield elements in such a way that they can be bent into a closed shape from flat sheet-metal blanks. Each clamp may optionally also include two or more individual parts, which in turn can be bent into a closed shape from flat sheet-metal blanks.

In accordance with a concomitant feature of the invention, in order to provide a simpler mounting, the clamps are secured against torsion such as can occur during mounting as the screws are turned. It is recommended that each clamp be provided with at least one torsion-preventing means, such as a small screw or an alignment pin.

Other features which are considered as characteristic for the invention are set forth in the appended claims.

Although the invention is illustrated and described herein as embodied in a heat shield configuration with low coolant consumption or requiring little coolant fluid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
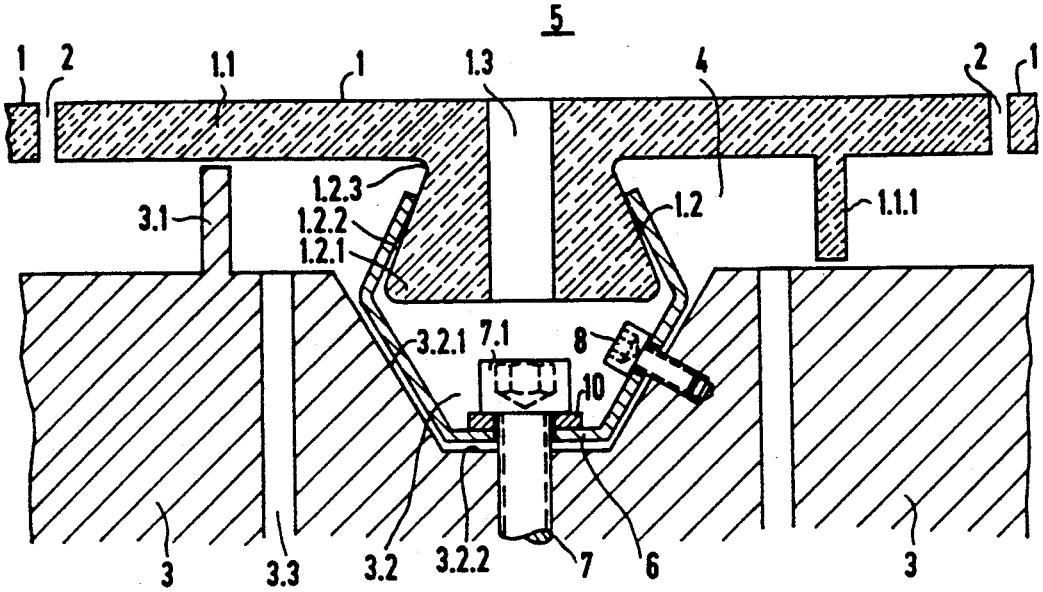
FIG. 1 is a fragmentary, diagrammatic, sectional view of a possible embodiment of a lining.

Referring now to the figures of the drawing in detail and first, particularly, to FIG. 1 thereof, there is seen an embodiment of a heat shield configuration having ceramic heat shield elements 1. It is seen that one of the heat shield elements 1 which is mushroom-shaped is anchored by means of a clamp 6 to a support structure 3. The clamps 6 are formed of heat-resistant or heat-proof material of substantially greater elasticity than that of the material of the heat shield element 1, in particular metal or heat-resistant or heat-proof alloys. The shaping of the clamps 6 causes them to act as springs in the fixation of the heat shield elements 1 on the support structure 3, and they substantially determine the force with which the heat shield elements 1 are retained on the support structure 3. Expansion gaps 2 which enable thermal deformation of cap portions 1.1 are located between the cap portions 1.1 of each two heat shield elements 1. The penetration of hot fluid from a hot-gas chamber 5 through the expansion gaps 2 and bores 1.3 that may possibly be present in the heat shield elements 1 into a space 4 between the heat shield element 1 and the support structure 3, can be prevented by delivering barrier fluid through the channels 3.3.

The clamp 6 is secured to the support structure 3 by means of a screw 7 with a screw head 7.1 and torsion-preventing means 8. In FIG. 1, the screw 7 is shown partly loosened. Optionally, a shim 10 can also be introduced between the screw 7 and the clamp 6 as torsion-preventing means.

In order to fix the heat shield elements to the support structure, firm props must be present. FIG. 1 shows two exemplary embodiments in which the heat shield elements are supported from below at the cap portions 1.1. The two embodiments include props 3.1 or 1.1.1 firmly joined to either the support structure 3 or to a cap portion 1.1.

FIG. 1 also shows a shank portion 1.2 of a heat shield element having annular beads 1.2.1 at an end facing away from the cap portion 1.1, lateral surfaces 1.2.2, and recesses 1.2.3 at the transition from the shank portion 1.2 to the cap portion 1.1. The support structure 3 has a countersunk recess 3.2 with a bottom surface 3.2.2 and an oblique wall 3.2.1. These elements will be used to describe the prop structure of FIG. 2.

Figure 2:
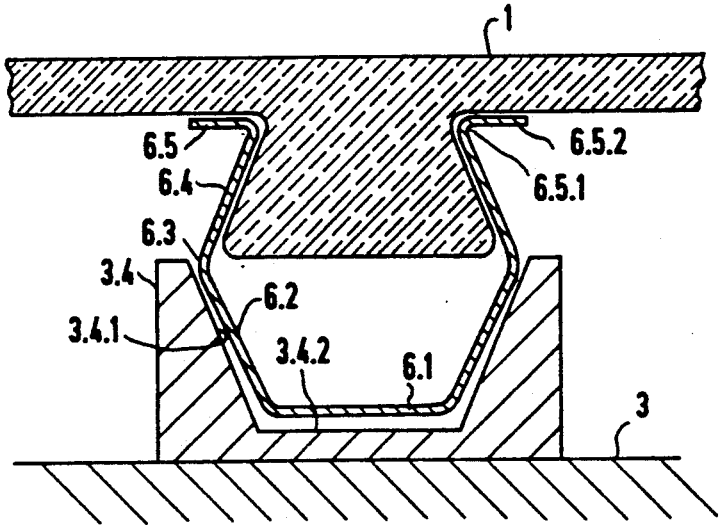
FIG. 2 is a view similar to FIG. 1 of a special embodiment of a clamp.

Another possible embodiment for the props is shown in FIG. 2. In this case props 6.5 are integrated with the clamps 6 and include supporting kinks or bulges 6.5.1 which engage the recesses 1.2.3, and supporting or bearing surfaces 6.5.2 on which the cap portion 1.1 rests.

As FIG. 2 shows, for a special embodiment, the essential portions of the clamp 6 are at least one retaining element, which encompasses the lateral surface 1.2.2 and is constructed as a conical lateral surface 6.4 of the clamp 6, and at least one spring element, which is represented in FIG. 2 by a kink 6.3. The clamp also has a bottom portion 6.1 and another lateral portion 6.2. The precise shape of whichever part of the clamp 6 is secured to the heat shield is of lesser importance to the invention.

Figure 3:
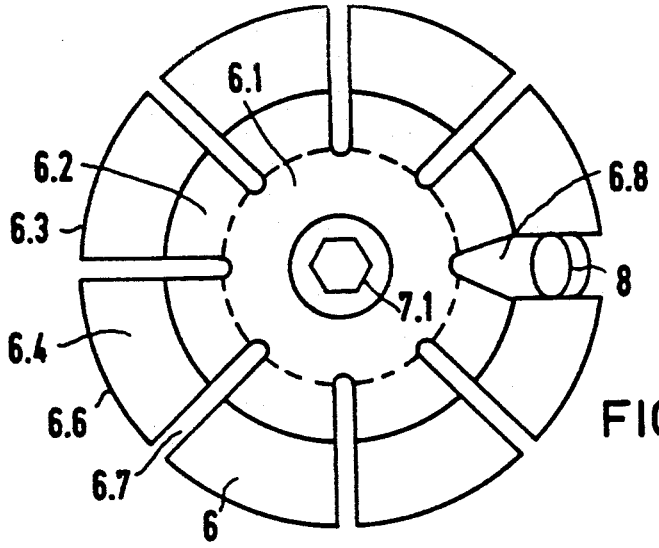
FIG. 3 is an elevational view of the clamp as viewed from the hot-gas side.
Figure 4:
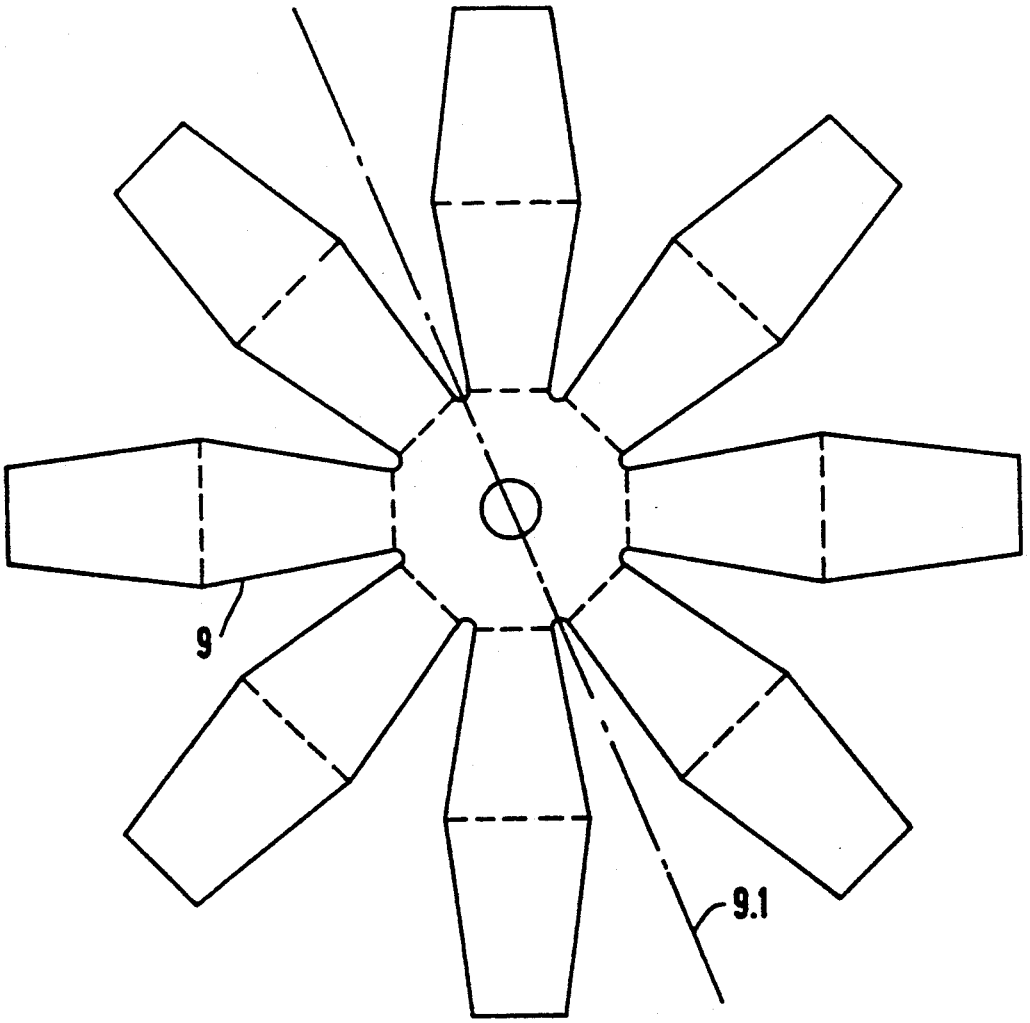
FIG. 4 is an elevational view of a blank from which the clamp can be made by bending.

In a preferred embodiment, the clamp 6 is bent from a sheet-metal blank 9, as shown in FIG. 4. FIG. 3 shows the bent clamp 6 without the heat shield element 1, as viewed from the side facing the hot-gas chamber 5. Between various clamp lugs 6.6 are slits 6.7, which assure the deformability of the clamp 6 on one hand, and the circulation of the barrier fluid on the other. An enlarged slit 6.8 serves to receive the torsion-preventing means 8. If the clamp 6 is to be shaped even before final mounting of the heat shield element 1, the blank 9 can be split, for instance as suggested by a dividing line 9.1. The clamp 6 is secured in the countersunk recess 3.2 of the support structure 3 or in a separate socket 3.4 attached to the support structure 3. This is preferably accomplished with the screw 7 in the form of a socket-head screw, that is possibly accompanied by the torsion-preventing means 8, which may be a screw, an alignment pin or the like. Besides the oblique wall 3.2.1 of the recess 3.2, the socket has an oblique wall 3.4.1 as well. The bottom surface 3.2.2 of the recess 3.2 as well as a bottom surface 3.4.2 of the socket 3.4 should have a slightly larger diameter than the bottom portion 6.1 of the clamp 6, in order to assure that the clamp 6 can be pulled inward as far as the bottom surfaces 3.2.2, 3.4.2. The bore 1.3 enables access to the screw head 7.1 while the heat shield element 1 is being mounted. It is desirable to provide a limitation of the tensile force with which the heat shield element 1 is retained on its props 1.1.1, 3.1 or with which the supporting surfaces 6.5.2 are effected whenever the tension in the resilient kink 6.3 of the clamp 6 reaches the limit of plasticity. In order to accomplish this, the thickness of the clamp blank 9 should be selected in accordance with the material properties, in such a way that the maximum tensile force is still restricted to a safe amount with respect to the danger of breakage of the ceramic of the heat shield elements 1.

I claim:

1. Heat shield configuration for structures carrying hot fluid, comprising adjacent mushroom-shaped ceramic material heat shield elements being mutually spaced apart defining expansion gaps therebetween, each of said heat shield elements having a surface-covering polygonal cap portion and a shank portion with an end facing away from said cap portion, said ends of said shank portions having beads formed thereon, a support structure on which said heat shield elements are anchored at a distance defining a space between said support structure and said heat shield elements to be subjected to fluid through channels formed in said support structure, clamps securing said beads to said support structure, and additional means for supporting said heat shield elements against said support structure, said clamps being formed of heat-resistant material with substantially greater elasticity than said ceramic material of said heat shield elements, said clamps having shapes forming springs fixing said heat shield elements on said support structure, and said clamps substantially determining a force with which said heat shield elements are retained on said support structure.

2. Heat shield configuration according to claim 1, wherein the structures carrying hot fluid are metal components of gas turbine systems and combustion chambers.

3. Heat shield configuration according to claim 1, wherein said cap portions are flat and have straight outer edges.

4. Heat shield configuration according to claim 1, wherein said cap portions are curved and have curved outer edges.

5. Heat shield configuration according to claim 1, wherein said clamps are metal.

6. Heat shield configuration according to claim 1, wherein said clamps are formed of heat-resistant alloys.

7. Heat shield configuration according to claim 1, wherein said heat shield elements are supported on said cap portions.

8. Heat shield configuration according to claim 1, wherein said heat shield elements are supported on said shank portions.

9. Heat shield configuration according to claim 1, including props for said heat shield elements being firmly joined to said support structure.

10. Heat shield configuration according to claim 1, including props for said heat shield elements being firmly joined to said heat shield elements.

11. Heat shield configuration according to claim 1, wherein said shank portions have recesses, and said clamps form props with bulges engaging said recesses and bearing surfaces on which said cap portions rest.

12. Heat shield configuration according to claim 1, wherein said cap portions and shank portions have holes formed therein extending longitudinally completely through said shank portions.

13. Heat shield configuration according to claim 12, wherein said additional supporting means include screws having heads disposed along an imaginary extension of said holes.

14. Heat shield configuration according to claim 1, wherein said shank portions have trapezoidal cross sections in at least one plane with longer trapezoidal sides disposed at said ends of said shank portions facing away from said cap portions.

15. Heat shield configuration according to claim 14, wherein said trapezoidal cross sections have rounded angles.

16. Heat shield configuration according to claim 1, wherein said shank portions have bodies with shapes being at least approximately generated by rotation.

17. Heat shield configuration according to claim 1, wherein said clamps are seated in countersunk recesses formed in said support structure.

18. Heat shield configuration according to claim 1, including sockets secured to said support structure in which said clamps are seated.

19. Heat shield configuration according to claim 17, wherein each of said clamps has approximately the shape of a bulging barrel with slit walls.

20. Heat shield configuration according to claim 17, wherein each of said clamps has approximately the shape of a convex double cone with double truncation and slit walls.

21. Heat shield configuration according to claim 18, wherein each of said clamps has approximately the shape of a bulging barrel with slit walls.

22. Heat shield configuration according to claim 18, wherein each of said clamps has approximately the shape of a convex double cone with double truncation and slit walls.

23. Heat shield configuration according to claim 19, wherein each of said clamps is bent into a closed shape from a respective star-shaped flat sheet-metal blank.

24. Heat shield configuration according to claim 20, wherein each of said clamps is bent into a closed shape from a respective star-shaped flat sheet-metal blank.

25. Heat shield configuration according to claim 21, wherein each of said clamps is bent into a closed shape from a respective star-shaped flat sheet-metal blank.

26. Heat shield configuration according to claim 22, wherein each of said clamps is bent into a closed shape from a respective star-shaped flat sheet-metal blank.

27. Heat shield configuration according to claim 1, wherein each of said clamps has at least two individual parts.

28. Heat shield configuration according to claim 27, wherein said individual parts of said clamps are bent into a closed shape from flat sheet-metal blanks.

29. Heat shield configuration according to claim 1, wherein said additional supporting means include at least one torsion-preventing means for each respective one of said clamps.

* * * * *